US009631382B2

(12) United States Patent
Murphy

(10) Patent No.: US 9,631,382 B2
(45) Date of Patent: Apr. 25, 2017

(54) CRACK SEALER PRODUCT AND METHOD

(76) Inventor: Joseph Murphy, Avon, CT (US)

( * ) Notice: Subject to any disclaimer, the term of this patent is extended or adjusted under 35 U.S.C. 154(b) by 759 days.

(21) Appl. No.: 13/336,345

(22) Filed: Dec. 23, 2011

(65) Prior Publication Data

US 2012/0168467 A1 Jul. 5, 2012

Related U.S. Application Data

(60) Provisional application No. 61/427,828, filed on Dec. 29, 2010.

(51) Int. Cl.
*A47G 19/14* (2006.01)
*E04G 23/02* (2006.01)
*E01C 23/09* (2006.01)

(52) U.S. Cl.
CPC ..... *E04G 23/0203* (2013.01); *E01C 23/0973* (2013.01)

(58) Field of Classification Search
USPC ..... 222/475, 475.1, 465.1, 570
See application file for complete search history.

(56) References Cited

U.S. PATENT DOCUMENTS 1,447,117 A * 2/1923 Balison et al. ..... 222/556
2,564,979 A * 8/1951 Jorgensen ..... 222/570
2,744,809 A * 5/1956 Falligant ..... 137/318
3,114,484 A * 12/1963 Serio ..... 222/475.1
3,309,000 A * 3/1967 Haverstick ..... 222/569
3,330,449 A * 7/1967 Bloomfield et al. ..... 222/475
3,356,266 A * 12/1967 Pinter, Jr. ..... 222/192
3,430,804 A * 3/1969 Bernas ..... 222/567
3,899,107 A * 8/1975 Gaal ..... 222/570
3,994,424 A * 11/1976 Koeller ..... 222/570
4,203,537 A * 5/1980 McAlister ..... 222/570
4,702,395 A * 10/1987 Nitsch ..... 222/109
4,911,319 A * 3/1990 DeJean ..... 222/570
5,234,133 A * 8/1993 Kensey ..... 222/189.07
5,720,408 A * 2/1998 Schmid et al. ..... 220/287
6,290,428 B1 * 9/2001 Hall et al. ..... 404/75
7,967,040 B1 * 6/2011 Sanford ..... B65D 71/502 141/319
2007/0295768 A1 * 12/2007 Gringer et al. ..... 222/570
2008/0223810 A1 * 9/2008 Garcia ..... 215/201
2008/0277418 A1 * 11/2008 Vockler et al. ..... 222/111
2009/0159607 A1 * 6/2009 Kratzer ..... 220/849

* cited by examiner

*Primary Examiner* — Patrick M Buechner
*Assistant Examiner* — Jeremy W Carroll

(57) ABSTRACT

A product and method for sealing cracks in pavements, roofs, or the like utilizes a can containing a tar sealant. The tar sealant is a solid at room temperature and assumes a fluid state pourable from the can when the tar sealant is heated in the can to a temperature above the melting temperature of the tar sealant. A spout and handle that can withstand the heat are fitted to the can for pouring the melted tar sealant in a fluid state from the can into a crack to be sealed.

16 Claims, 5 Drawing Sheets

CRACK SEALER PRODUCT AND METHOD

CROSS-REFERENCE TO RELATED APPLICATIONS

This application claims the benefit of and priority to U.S. Provisional Patent Application No. 61/427,828, filed Dec. 29, 2010, the content of which is incorporated herein by reference in its entirety.

FIELD OF THE INVENTION

The present invention relates to a product enabling the application of an asphalt tar sealant to cracks in pavement, roofing and the like, and the method of using the product.

BACKGROUND OF THE INVENTION

Asphalt and concrete driveways, sidewalks, parking lots, and tarred roofs develop cracks with aging due to exposure to the weather elements, such as temperature changes, intense solar heating, water, and icing, and due to the treatment pavement receives in use such as heavy loading on a soft or defective foundation.

The typical treatment for cracks in the pavement and roofing is filling and sealing the cracks with an asphalt tar sealant which if properly applied can extend the useful life of the pavement or roofing for many years. The application of tar sealant generally requires a professional with special equipment in the form of a melter, that is, a double-walled heating vessel in which hard chunks of the asphalt tar sealant are melted, and from which the melted sealant is pumped and applied to a crack through a sometimes heated hose and metal wand. Heat from a propane or gas burner is transferred through oil between the double walls of the vessel to the hard chunks of sealant within the vessel, and the temperature of both the oil and the sealant are monitored. Generally the sealant melts and assumes a fluid state above 275° F. The melters are complex and costly pieces of equipment, and require maintenance and periodic cleaning to insure proper operation.

A typical homeowner would not usually have the melter equipment and possibly the skill to apply a hot tar sealant with a melter. Consequently he has the option of applying so-called cold patch material which is typically a composition of granular stone and soft tar. The cold patch material remains soft and pliable at room temperatures, and sets up with compaction. However, the cold patch material does not fill cracks and provide the seal against water or other fluids that is achieved with a hot tar sealant and hence produces far less satisfactory results.

It is accordingly an object of the present invention to provide a do-it-yourself product for the application of an asphalt tar sealant to cracks in pavement and a method of application of the sealant.

SUMMARY OF THE INVENTION

The present invention in one aspect relates to a do-it-yourself (DIY) product for applying an asphalt tar sealant to cracks in concrete or asphalt pavements, roofs and the like. The product comprises a metal can containing the asphalt tar sealant in a cool, solid state, and a pour spout that is or can be connected to the top of the can for pouring the asphalt tar sealant in a heated, fluid state from the can into a crack in a pavement or roof.

The metal can may have large opening in the top of the can for pouring the asphalt tar in a heated fluid state, and a closure lid which seals the opening when the can is not in use. The pour spout connects in sealing relationship with the large opening to prevent leakage of the hot fluid sealant around the opening and to direct the hot fluid sealant into the spout during pouring. The spout preferably includes a handle for pouring, and is preferably non-metallic and made of a high temperature polymer plastic, or a thermosetting phenolic resin which is a poor conductor of heat.

The present invention in another aspect relates to the method of sealing a crack in a pavement or roof with an asphalt tar sealant. The method comprises the steps of providing a metal can containing an asphalt tar sealant in a solid state, heating the tar sealant in the metal can to a temperature at which the tar sealant assumes a hot fluid state, and then pouring the hot asphalt tar sealant in the fluid state from the can into a crack to be sealed. The can may have an opening at the top for pouring, and a removable lid for closing the opening when the can is not in use.

The step of heating may comprise placing the metal can within or on a source of heat for transferring the heat from outside the can to the asphalt tar sealant within the can. The step of pouring may comprise attaching a pouring spout with a handle to the can, and tilting the can with the handle to pour the hot asphalt tar sealant in a fluid state into a crack. The handle may preferably be made of a heat insulating material.

By providing the asphalt tar sealant in a metal can, the home owner can heat the can on an outdoor grill or other heat source and then pour the sealant directly from the can into a crack to be sealed. The can and spout can also be re-used by refilling the can with additional chunks asphalt tar sealant, and again heating the can with sealant over a grill or other heat source readily available to the home owner. With the product and method of the present invention, a professional sealing of cracks in driveways or other pavements and roofs can be achieved with an asphalt tar sealant without the costly equipment used by professionals.

DESCRIPTION OF THE PREFERRED EMBODIMENTS

Figure 1:
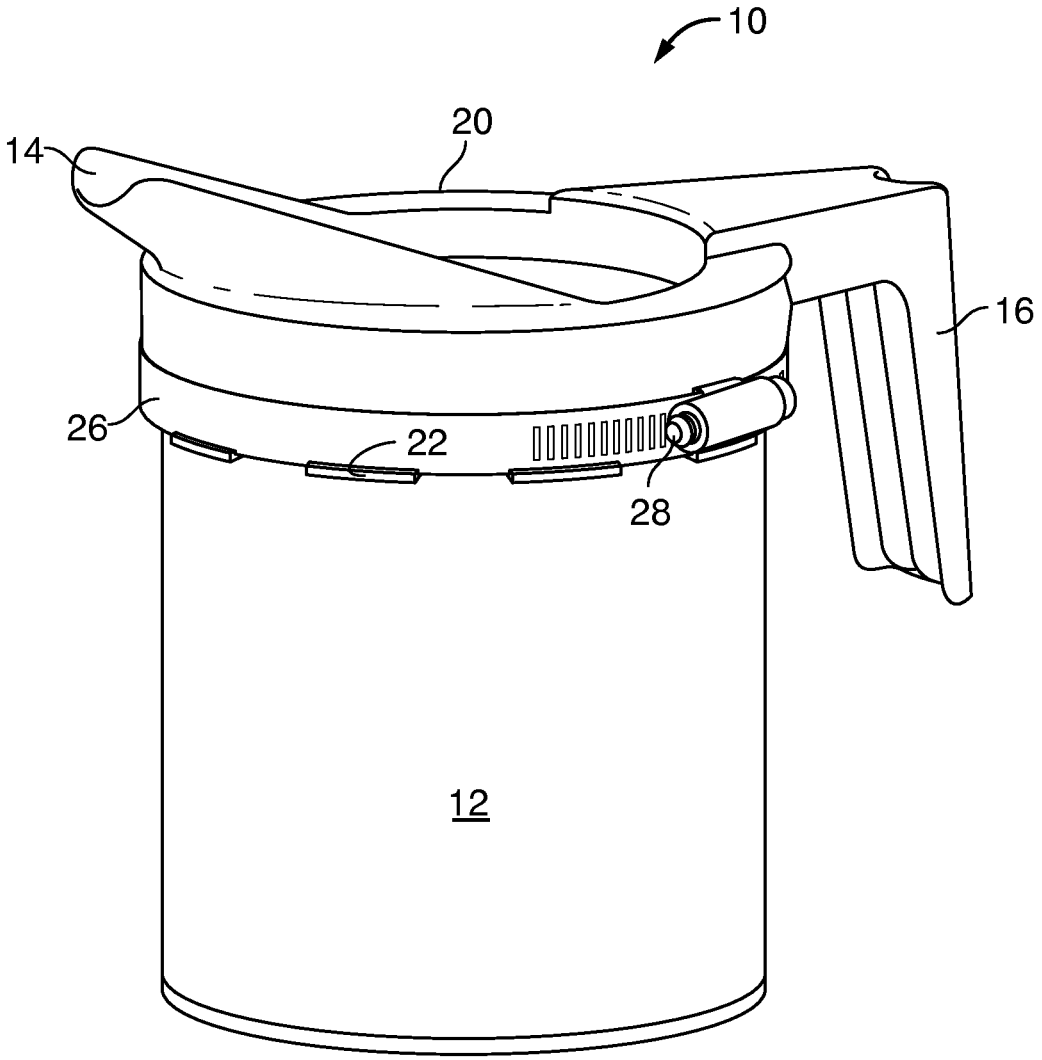
FIG. 1 is a perspective view of the crack sealer product illustrating the metal can and spout with an integral handle attached to top of the metal can.

FIG. 1 illustrates the crack sealer product 10 comprised basically of a metal can 12, and a removable spout 14 with an integral handle 16. The metal can contains an asphalt tar sealant 18 illustrated in FIGS. 6 and 7. The sealant is the same asphalt tar sealant used by professionals for crack sealing with the aid of melters in which chunks of the sealant are heated and converted to a hot fluid state and then pumped through a hose and wand to the cracks to be sealed.

Figure 6:
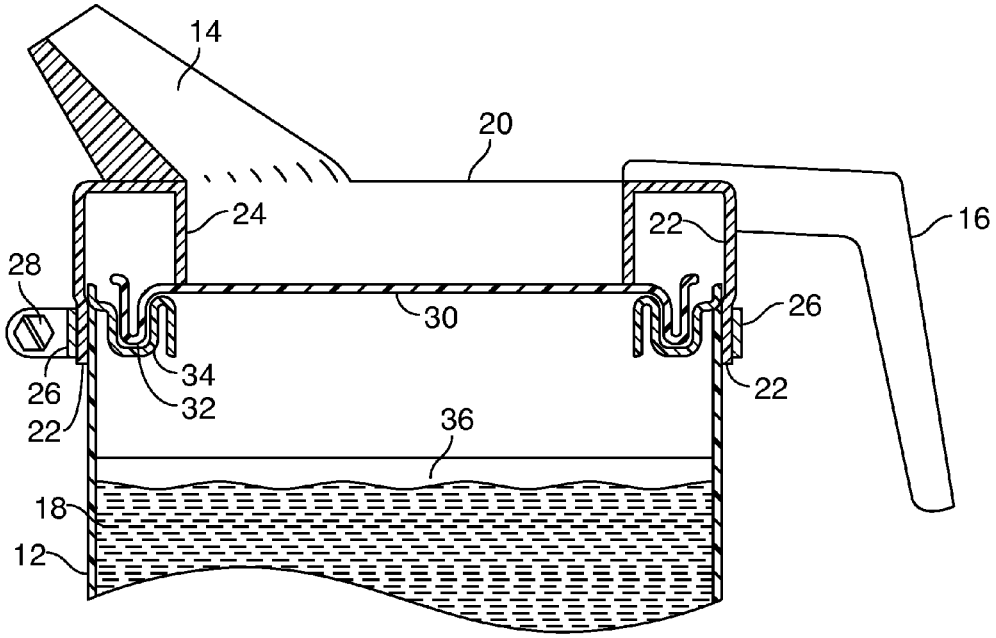
FIG. 6 is a cross sectional view of the top of the metal can and spout with a can lid in place.
Figure 7:
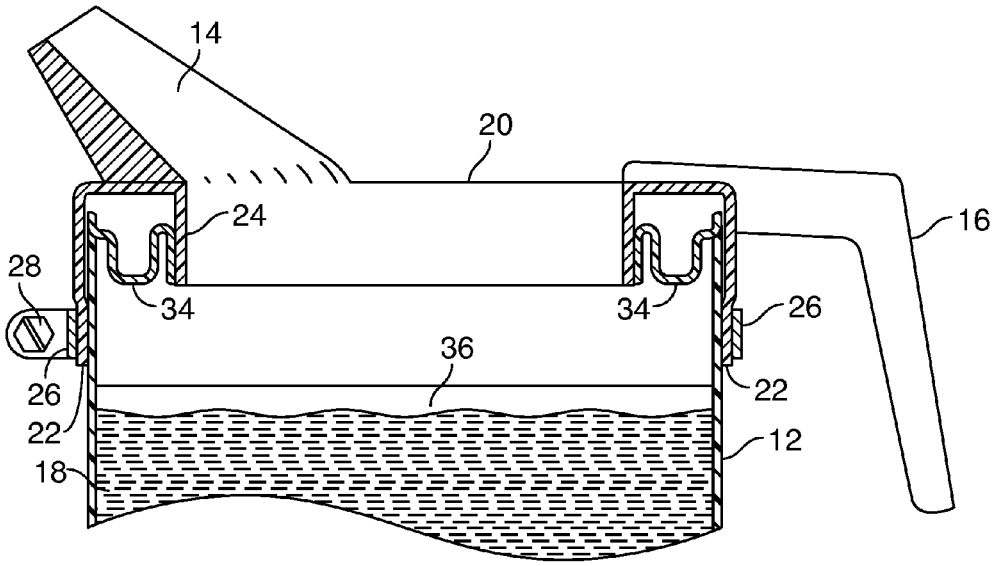
FIG. 7 is a cross sectional view of the top of the metal can with the can lid removed and the spout in place for pouring sealant.

As shown in FIGS. 2-5 the spout 14 and integral handle 16 can be molded from a high temperature polymer plastic impregnated with a glass or carbon fiber, for example, 30% fiber by volume, or a thermosetting phenolic formaldehyde resin, such as Bakelite. Such materials are poor conductors of heat, and are heat resistant and capable of withstanding temperatures above 275° F. at which the asphalt tar sealant melts and assumes a fluid state. The spout 14 and handle 16 are connected to opposite sides of a ring 20 which is fitted to the top of the can 12 as shown in FIGS. 1, 6, and 7. The ring includes an outer slotted skirt 22 and an inner solid skirt 24. The slotted skirt has a circumferential recess in which an adjustable metal securing strap 26 is retained. The slots render the skirt 22 radially flexible and allow the outer skirt and ring to be clamped securely to the top of the can 12 by tightening the adjusting screw 28.

FIG. 6 shows the top of the can 12 with a lid 30 having an outer folded flange 32 wedged in a corresponding annular recess in a sealing ring 34 crimped or soldered to the upper edge of the can wall as in a convention paint can. The seal between the lid 32 and sealing ring 34 is sufficient to retain the solidified tar 18 in the can; however, a layer of grease 36 or other non-adherent material can cover the top of the tar to prevent the tar, if melted in high temperature environments, from adhering to the lid during transit if the can is tilted or laying on its side.

With the lid 30 in place as shown in FIG. 6, the inner skirt 24 rests on the top of the lid while the outer skirt 22 being longer extends downward over the side of the can 12. Therefore, the securing strap 26 can be tightened around the can to hold the spout 14 and handle 16 firmly on the can. The product 10 can therefore be sold with the spout and handle either secured to the can 12 or separated from the can.

When the product 10 is used to seal cracks in asphalt pavements or other pavements and objects, the lid is removed and the spout 14 and handle 16 are mounted on the can 12 as shown in FIG. 7. The inner skirt 24 is inserted into the sealing ring 34 and forms a seal with the ring which prevents the asphalt tar in a heated and fluid state from escaping around the spout 14. Thus the skirt funnels the tar from the can into the spout. The slotted outer skirt 22 in the meantime is clamped to the can by means of the securing strap 26 so that the handle 16 can used to tip and pour the tar in the fluid state from the can 12.

Figure 8:
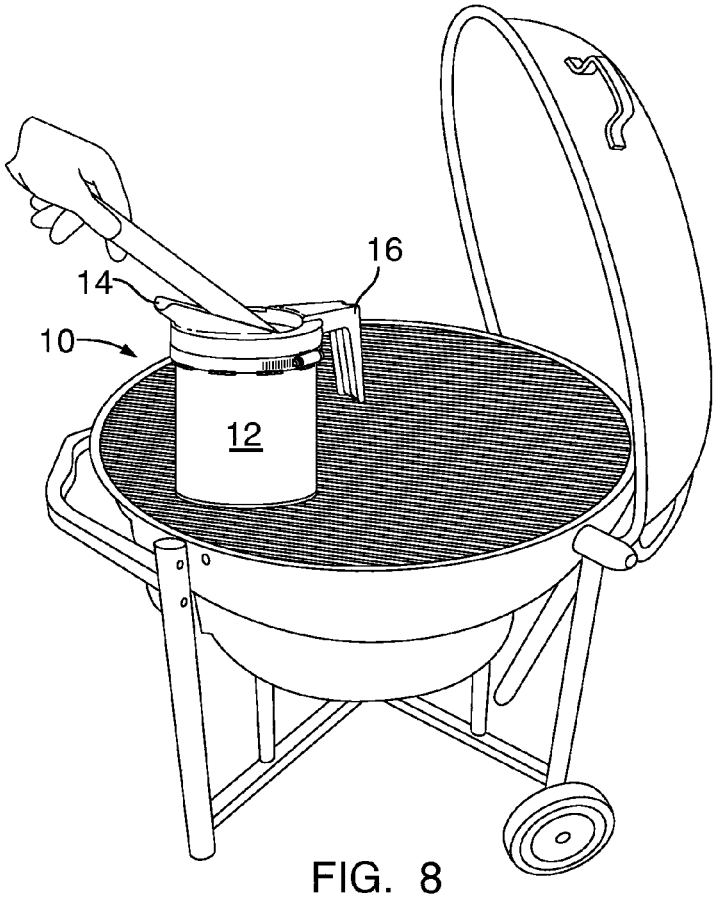
FIG. 8 illustrates the step of heating the metal can on an outdoor grill.
Figure 9:
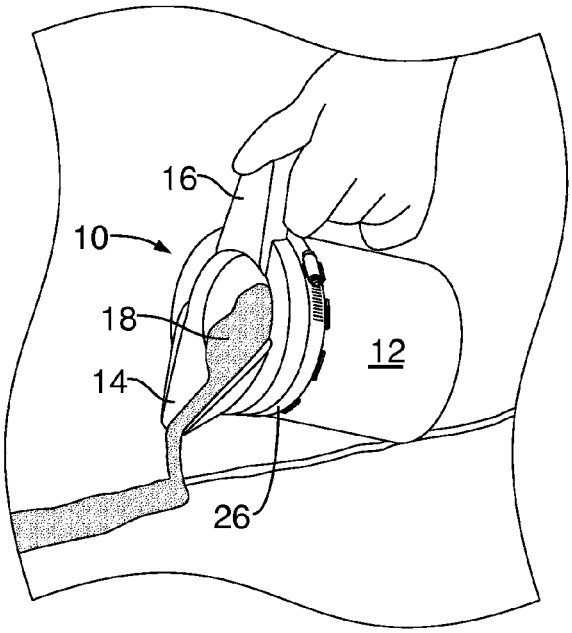
FIG. 9 illustrates the step of pouring the heated hot asphalt tar sealant from the metal can into a crack in a driveway pavement.
Figure 10:
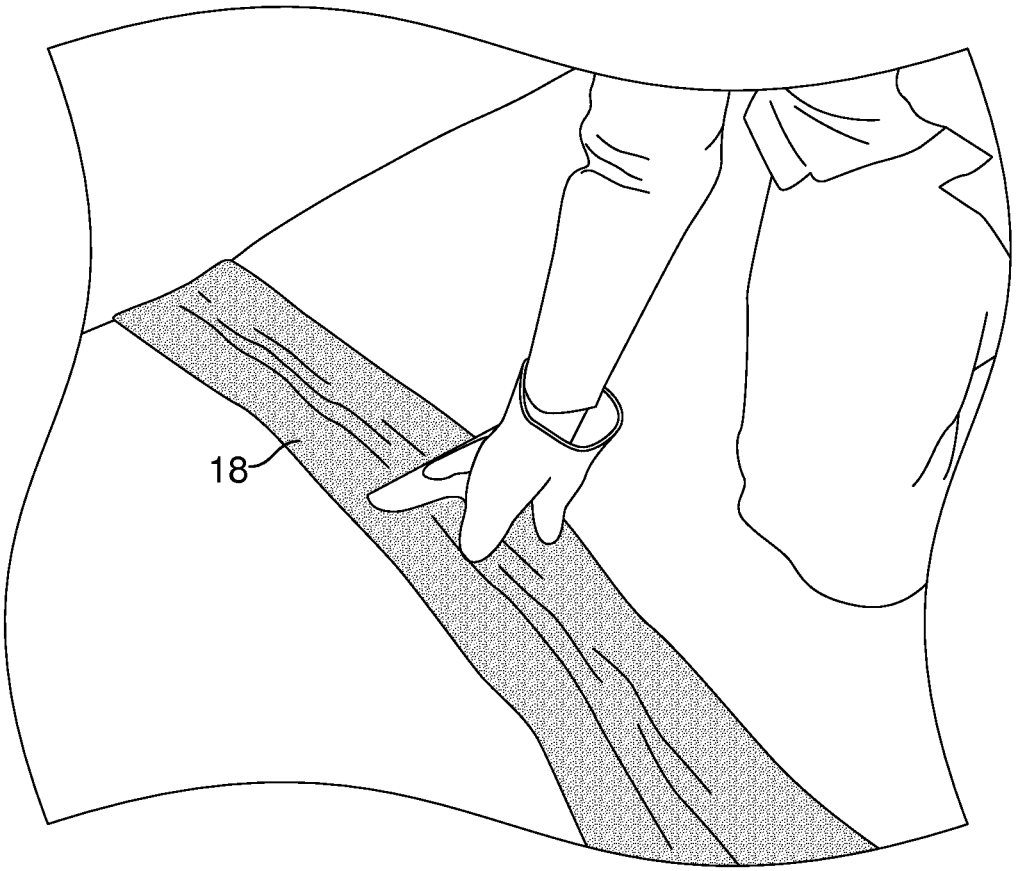
FIG. 10 illustrates the step of spreading the hot asphalt tar sealant into the crack and onto a small apron at each side of the crack.

FIGS. 8, 9, and 10 illustrate a method by which a home owner or other person can employ the product 10 to seal cracks in asphalt pavements and other pavements or objects without a large melter used by professionals.

With the lid 30 of the can 12 removed, the can is placed on an outdoor grill, fireplace, or other heating source as shown in FIG. 8. Depending on the size of the can and the heat source, the asphalt tar 18 in the can will change from a solid to a fluid state above 275° F. after a period of heating, for example, a half hour. The tar can be stirred as shown while heating to ensure that all the tar turns to a fluid state. The limited quantity of grease 36 covering the tar 18 in the can can be removed before heating, but generally will not interfere with sealing qualities of the tar which is typically also a petroleum-based product. The person performing the heating and stirring should wear protective gloves. The spout and handle being made from a heat resistant material can be mounted on the can during the heating step.

After the tar 18 has been heated and reaches a fluid state in the can 12, the can is removed from the heat source and the hot tar is poured directly from the can over the spout 14 into a crack to be sealed as shown in FIG. 9. The crack should be cleaned of dirt, weeds, and debris before the step of pouring the tar to obtain the best adhesion between the pavement and tar. The pouring is accomplished by grasping the handle 16 with gloves and tilting the can 12 to establish a flow of the hot fluid tar from the can 12 into the crack. The quantity of tar poured should be sufficient to fill the crack and allow an excess to overflow the crack onto aprons of the pavement at each side of the crack.

Immediately after the hot tar is poured in a crack and before the tar cools and sets, the tar can be pressed into the crack to fill the crack and be spread on to aprons of the pavement at each side of the crack with a putty knife as shown in FIG. 10. The tar preferably covers about one inch or more of the aprons to create a protective "bandage" sealing the crack.

After the tar is pressed and spread onto the aprons, the tar is allowed to cool and set up. When set up, the tar is hardened and can absorb traffic, but is sufficiently flexible to move with any shifting movements of the pavement.

If less than all the tar 18 in the can 12 is needed to fill a crack, the unused portion of the tar can be allowed to cool and set up in the can, and can be used again at a later time to fill other cracks using the same heating and pouring steps as described above. When all of the tar is used up, the can 12 can be refilled with chunks of asphalt tar, and be used again to fill other cracks.

As used in the description above, the term pavement is to be given a broad interpretation and includes driveways, streets, parking lots, runways, walkways, sidewalks, and the like. The reference to cracks includes not only cracks wholly within the pavement, but also cracks between the pavement and an adjacent structure, such as a crack between an asphalt driveway and a building or the concrete apron of a garage entrance.

Figure 2:
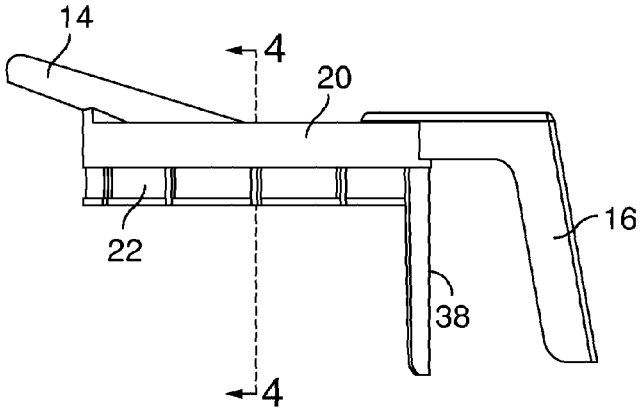
FIG. 2 is a detailed side elevation view of the spout and integral handle.
Figure 3:
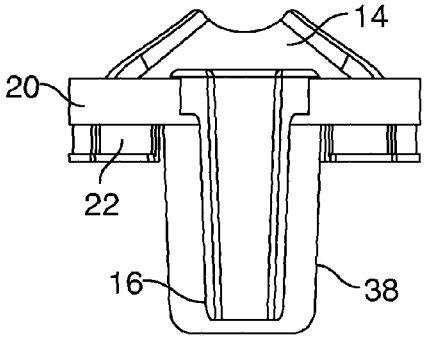
FIG. 3 is a detailed rear elevation view of the spout and integral handle.
Figure 4:
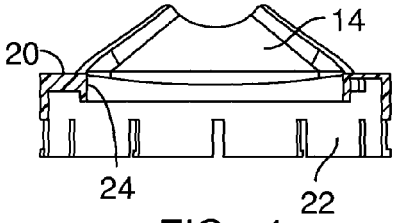
FIG. 4 is a sectioned rear elevation view of the spout and integral handle.
Figure 5:
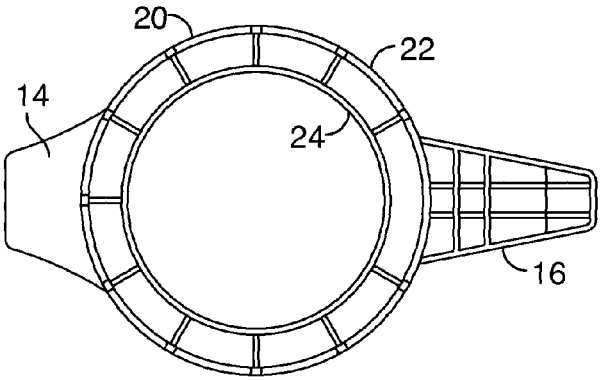
FIG. 5 is a detailed bottom plan view of the spout and integral handle.

The invention has been described in a preferred embodiment by way of illustration rather than limitation. For example, the spout 14 and handle 16 can be separate pieces attaching to the can 12, or can be formed as part of the metal can 12 provided that the handle is covered with a heat insulating material. A heat shroud 38 can be added to the ring 20 as shown in FIGS. 2 and 3 to provide additional protection from the heat for the person pouring the tar. A removable wax paper seal can be used instead of the grease on top of the tar 18 in the can 12. The product 10 is particularly useful for the do-it-yourself homeowner for filling cracks in pavements, but is also useful for professionals who work on small sealing jobs which do not justify taking a melter to a job site and firing up the large double-walled vessel.

The invention claimed is:

1. A product for sealing cracks in pavement, roofs, and the like, comprising:

a can having an opening for pouring the contents of the can from the can, the can being made from a material that can withstand heating of the contents to a temperature in excess of 275° F. from an external source;

a spout fitted to the can for pouring heated contents from the opening of the can;

a handle fitted to the can for tilting the can and pouring the heated contents from the opening of the can; and an asphalt tar sealant disposed in the can in heat transfer relationship with the can, the tar sealant being a solid at room temperature and assuming a fluid state pourable from the can when heated to a temperature in excess of 275° F.

2. A product for sealing cracks as defined in claim 1 wherein the spout and handle are detachable from the can.

3. A product for sealing cracks as defined in claim 2 wherein the spout and handle are integrally connected to one another.

4. A product for sealing cracks as defined in claim 1 wherein the spout and handle are made of a material that can withstand the heat when the tar sealant is heated in the can above 275° F. to assume the fluid state.

5. A product for sealing cracks, comprising:

a can from which contents can be poured when the can is opened, the can being made from a metal that can withstand heating of the contents in the can from a heat source external to the can;

a spout fitted to the can for pouring contents in a fluid state from the can when opened;

a handle fitted to the can for tilting the can and pouring the contents in a fluid state from the can when opened; and an asphalt tar sealant disposed in the can to receive heat within the can from a heat source external to the can, the tar sealant being a solid at room temperature and assuming a fluid state pourable from the can when heated to a temperature above its melting temperature.

6. A product for sealing cracks as defined in claim 5 wherein the spout is detachable from the can.

7. A product for sealing cracks as defined in claim 5 wherein the spout and handle are integrally connected to one another, and are detachable and attachable to the can.

8. A product as defined in claim 7 wherein the integrally connected spout and handle are molded from a high temperature polymer plastic.

9. A product as defined in claim 7 wherein the integrally connected spout and handle are molded from a high temperature, fiber impregnated polymer plastic.

10. A product as defined in claim 7 wherein the integrally connected spout and handle are molded from a thermosetting resin.

11. A product as defined in claim 5 wherein:

the can has a top with a removable lid that when removed exposes an opening in the top of the can; and the spout is detachable from the can and connected with a sealing ring that fits in sealing relationship with the opening in the top of the can when the lid is removed and the spout is attached to the can.

12. A product for sealing cracks as defined in claim 5 wherein the can has a top with a removable lid that fits in sealed relationship with the top of the can when not removed, and that exposes an opening in the top of the can when removed;

a sealing ring is provided that fits in sealing relationship with the opening in the top of the can when the lid is removed and fits over the top of the can and the lid when the lid is not removed; and the handle is connected with the sealing ring for attachment and detachment from the can.

13. A product as defined in claim 12 wherein the spout is also connected with the sealing ring.

14. A product as defined in claim 12 further including a heat shroud connected with the sealing ring in spaced relationship with the handle to shield persons gripping the handle from the heat of the can.

15. A product as defined in claim 12 wherein:

the sealing ring has a skirt that circumscribes the outside of the can at the top when the lid is removed and the sealing ring is in sealing relationship with the opening in the top of the can; and a tensioning strap circumscribes the skirt for securing the sealing ring to the top of the can.

16. A product as defined in claim 15 wherein:

the sealing ring fits over the top of the can when the lid is not removed;

the skirt of the sealing ring is dimensioned to circumscribe the outside of the can at the top when the lid is not removed and the sealing ring rests on the top of the can, whereby the tensioning strap can secure the sealing ring and handle to the can.

* * * * *